US005661928A

United States Patent [19]

Beu

[11] Patent Number: 5,661,928

[45] Date of Patent: Sep. 2, 1997

[54] AUTOMATIC END CLOSURE SYSTEM FOR BLEACHERS

[75] Inventor: Roger H. Beu, Crystal Lake, Ill.

[73] Assignee: B & R Erectors, Inc., Woodstock, Ill.

[21] Appl. No.: 639,169

[22] Filed: Apr. 26, 1996

[51] Int. Cl.[6] ..... E04H 3/12

[52] U.S. Cl. ..... 52/9; 52/67; 160/202

[58] Field of Search ..... 52/10, 67, 182, 52/183, 191, 188, 8, 9; 160/201, 202; 182/223

[56] References Cited

U.S. PATENT DOCUMENTS

| | | | |
|---|---|---|---|
| 1,818,428 | 8/1931 | Paysen . | |
| 2,575,593 | 11/1951 | Peery . | |
| 2,740,165 | 4/1956 | Ward . | |
| 2,850,089 | 9/1958 | Burke | 160/202 |
| 2,859,488 | 11/1958 | Mackintosh . | |
| 3,564,790 | 2/1971 | Rehfeld . | |
| 3,745,725 | 7/1973 | Boucaud | 52/67 |
| 4,934,113 | 6/1990 | Hall et al. | 182/223 X |
| 4,997,165 | 3/1991 | Wiese | 52/9 X |
| 5,069,007 | 12/1991 | Paddock | 52/9 |
| 5,156,195 | 10/1992 | Wehler et al. | 52/67 X |
| 5,167,341 | 12/1992 | Morton et al. | 52/67 X |
| 5,328,238 | 7/1994 | Yamazaki . | |

*Primary Examiner*—Michael Safavi
*Assistant Examiner*—Timothy B. Kang
*Attorney, Agent, or Firm*—McCaleb, Lucas & Brugman

[57] ABSTRACT

An automatic end closure system for use in conjunction with a typical telescoping bleacher assembly. The automatic end closure system substantially blocks ingress and egress to the undersection of the telescoping bleacher assembly which prevents mischievous or curious spectators from causing harm to themselves or to the equipment contained in the undersection. The automatic end closure system basically includes a plurality of panels, a plurality of guidance tracks, a plurality of panel locking engagements and wheels. Each of the panels may be composed of an inner metal framing covered with a wooden facade. The automatic end closure system may be an add-on or integrated component of the telescoping bleacher assembly. Once connected to the telescoping bleacher assembly, the automatic end closure system automatically expands and retracts with the expansion and retraction of the telescoping bleacher assembly. When the automatic end closure system is in its retracted state, the plurality of panels rests in horizontal juxtaposition to each other thereby conserving space when not in use for an event.

18 Claims, 3 Drawing Sheets

AUTOMATIC END CLOSURE SYSTEM FOR BLEACHERS

BACKGROUND OF THE INVENTION

1) Field of the Invention

The present invention relates generally to telescoping bleacher assemblies, and more particularly to an automatic end closure system for utilization in conjunction with telescoping bleacher assemblies as an add-on or integrated component.

2) Description of the Related Art

Telescoping bleacher assemblies are widely used in gymnasiums, sports arenas and other similar facilities throughout the country. The telescoping bleacher assembly is extended from a retracted position to an extended position to provide seating for an event. When the seating is no longer needed, the bleacher is retracted to allow for a greater open space in the gymnasium or arena. The space saving feature of these telescoping bleacher assemblies make them ideal for gymnasiums and arenas where the seating needs change depending on the event. However, when the telescoping bleacher assembly is extended, the undersection of the bleacher is exposed to the public. In the past, such exposed undersections might not have posed a problem to the owners and operators of such facilities. However in this day and age of the aggressive sports fan, negligent parents who become too involved in the event and pay little attention to their children, and the ever increasing number of destructive juvenile delinquents, owners and operators see exposed undersections as sites of potential liability or mischievous activity.

The undersection may contain various hazards depending on the type of telescoping bleacher assembly. If the bleacher assembly is one that automatically extends and retracts then the drive mechanism is open to intruders who may vandalize the mechanism. If the bleacher assembly is extended and retracted by tractor then intruders might still wreak havoc on the understructure of the bleacher assembly. There is also the possibility of children or adults who may stray into the undersection of the bleacher assembly and cause harm to themselves including the possibility of being enclosed in the undersection when the bleacher assembly is retracted after an event. In addition to the "common" type of misbehavior, increased terrorism from foreign and domestic sources make exposed undersections tempting targets for concealing explosive devices. Therefore, the potential liability due to exposed undersections of telescoping bleacher assemblies is tremendous.

The prior art has failed to address this potential liability arising from an exposed undersection of a telescoping bleacher assembly. Instead, the prior art has focused its attention on improving safety for the uppersection of telescoping bleacher assemblies by inventing various guard rails for attachment to or integration into the bleacher assemblies. The guard rails are often attached to the seats of the bleacher assembly in order to prevent well-behaved spectators from accidentally falling off the end of the bleacher assembly. However, what is equally needed is an apparatus for protecting the undersection of the bleacher assembly from mischievous or curious spectators. Unlike the uppersection where identical guard rails units may be used, protecting the undersection requires matching the protective units to the descending height of each forward row of seats. This also requires a guiding system which would not interfere with the extension and retraction of the bleacher assembly. Also, substantially the entire end of the bleacher assembly must be substantially covered which requires a moveable apparatus of greater weight and complexity than the guard rail units of the uppersection. At the same time such factors cannot be detrimental to the easy extension and retraction of the bleacher assembly.

It therefore will be appreciated by those in the pertinent art that there has been a substantial need for enclosing the undersection of the telescoping bleacher assembly without deterring from the telescoping feature of the bleacher assembly. The present invention fulfills this need and provides other related advantages.

SUMMARY OF THE INVENTION

The present invention provides the necessary protection of the undersection of telescoping bleacher assemblies while not deterring from the easy extension and retraction of such bleacher assemblies. The present invention meets the needs of the pertinent art by providing an automatic end closure system for preventing ingress and egress of the undersection of telescoping bleacher assemblies. The present invention also provides an apparatus which is an add-on or integrated component to telescoping bleacher assemblies.

In its most basic form, the automatic end closure system of the present invention comprises a plurality of panels attached to the telescoping bleacher assembly, a plurality of top guidance tracks attached to each panel of the plurality of panels for guiding the plurality of panels during extension and retraction of the telescoping bleacher assembly, a plurality of bottom guidance tracks attached to each panel of the plurality of panels for also guiding the plurality of panels during extension and retraction of the telescoping bleacher assembly, and wheels connected to each panel of the plurality of panels for undersupporting the same.

The automatic end closure system further may comprise a means for anchoring the automatic end closure system to a stationary support such as a wall. The automatic end closure system further may comprise a plurality of panel locking engagements integrated into each track of the plurality of top guidance tracks and each track of the plurality of bottom guidance tracks. Also, each of the bottom and top guidance tracks are composed of an upper arm and a lower rail with the upper arm on one panel and the lower rail on a neighboring panel. In this design, the top and bottom guidance tracks connect each of the panels to each other in a non-interfering manner. The automatic end closure system still further may comprise means for attaching the plurality of panels to the frame of the telescoping bleacher assembly for automatic movement of the automatic end closure system with the movement of the telescoping bleacher assembly.

In alternative embodiment, the automatic end closure system of the present invention is integrated into the telescoping bleacher assembly. In this embodiment, the telescoping bleacher assembly comprises a plurality of rows of seats and foot decks supported on a series of moveable flames, and an automatic end closure structure. The plurality of rows of seats and foot decks are capable of extending forward to an extended state where the plurality of rows of seats and foot decks are in descending spaced relation to each other. The plurality of rows of seats and foot decks are also capable of retracting rearward to a retraction state where the rows are superimposed upon each other in a vertical column. The automatic end closure structure includes a plurality of panels attached to the frame of the bleacher assembly, a plurality of top guidance tracks attached to each panel of the plurality of panels, a plurality of bottom guidance tracks attached to each panel of the plurality of panels for moveably undersupporting the same, and means for anchoring the automatic end closure structure to a stationary support.

The telescoping bleacher assembly of this embodiment further may comprise a plurality of panel locking engagements integrated into each track of the top guidance tracks and each track of the bottom guidance tracks. Also in this embodiment, each of the bottom and top guidance tracks are composed of an upper arm and a lower rail with the upper arm on one panel and the lower rail on a neighboring panel. In this design, the top and bottom guidance tracks connect the panels to each other in a non-interfering manner.

In a more detailed embodiment of the present invention, the automatic end closure system is connected to a telescoping bleacher assembly which extends and retracts. The bleacher -assembly has an undersection exposed on at least one end and a plurality of rows of seats and foot decks supported on cantilever flames. In the extended state, the plurality of rows of seats and foot decks are extended forward and are spaced in descending relation to each other. In the retracted state, the plurality of rows of seats and foot decks are retracted rearward and are superimposed upon each other in a vertical column. The automatic end closure system comprises a plurality of panels for substantially preventing ingress and egress to the undersection of the bleacher assembly. Each panel of the plurality of panels corresponds in height to the vertical distance from the floor to the foot deck of the bleacher assembly above the panel, and correspond in length to two rows of seats of the bleacher assembly. A rear most panel is anchored to a stationary support such as a wall. The automatic end closure system also comprises a plurality of top guidance tracks attached to the upper region of each panel of the plurality of panels for interconnecting the plurality of panels to one another and for latitudinally slidably guiding the plurality of panels during extension and retraction of the bleacher assembly. The automatic end closure system in this embodiment also comprises a plurality of bottom guidance tracks attached to the lower region of each panel of the plurality of panels for interconnecting the plurality of panels to one another and for latitudinally slidably guiding the plurality of panels during extension and retraction of the bleacher assembly. The automatic end closure system also comprises wheels connected to the bottom of each panel of the plurality of panels for moveably undersupporting the same and a plurality of panel locking engagements integrated into each track of the plurality of top guidance tracks and bottom guidance tracks for preventing disconnection of the plurality of panels during extension and retraction and for maintaining the integrity of the automatic end closure system.

The automatic end closure system in this embodiment has each track of the plurality of guidance tracks consisting of an upper arm connected to one of the plurality of panels and a lower rail connected to an adjacent panel. The upper arm overlaps the lower rail thereby interconnecting succeeding panels from rearward to forward. During extension of the automatic end closure system the most forward panel is extended until the panel locking engagement engages an immediately rearward panel for extension thereof in a like manner. The progression of panels continues in this manner until all of the plurality of panels are fully extended.

In a very specific embodiment of the present invention, the automatic end closure system includes five panels of increasing height at opposite ends of the telescoping bleacher assembly. It being recognized that the number of panels will vary depending on the number and size of the bleacher sections to be covered by the automatic end closure system. In another specific embodiment, the plurality of panels are composed of an inner metal frame substantially covered with a wooden facade.

It is an object of the present invention to provide an automatic end closure system for blocking ingress and egress to the exposed undersection of a telescoping bleacher assembly.

It is a further object of the present invention to provide an apparatus which increases the safety of a telescoping bleacher assembly.

It is a further object of the present invention to provide an apparatus to decrease the potential liability of a telescoping bleacher assembly.

It is a further object of the present invention to provide an apparatus for protecting the drive motor and related mechanisms of the telescoping bleacher assembly.

Having briefly described this invention, the above and further objects, features and advantages thereof will be recognized by those of skill in this art from the following detailed description of a preferred embodiment of the invention as illustrated in the accompanying drawings.

BRIEF DESCRIPTION OF THE DRAWINGS

The present invention is further described in connection with the accompanying drawings, in which.

DETAILED DESCRIPTION OF THE INVENTION

Figure 1:
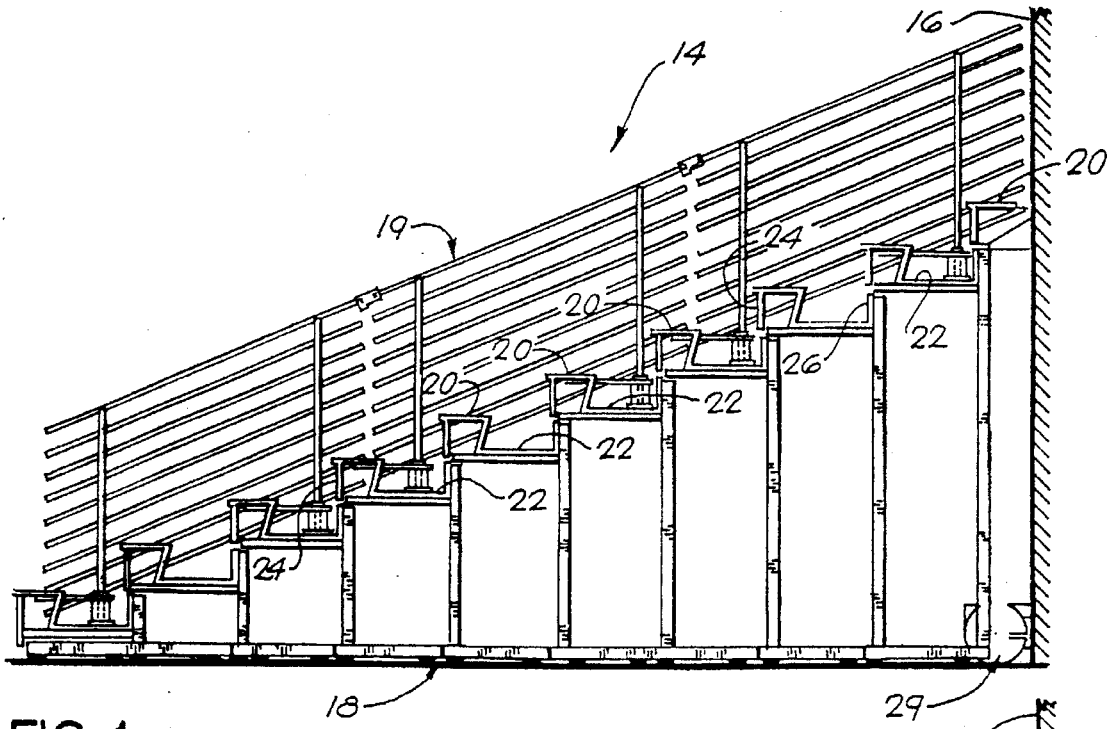
FIG. 1 is a side perspective of a typical telescoping bleacher assembly in the extended state.
Figure 2:
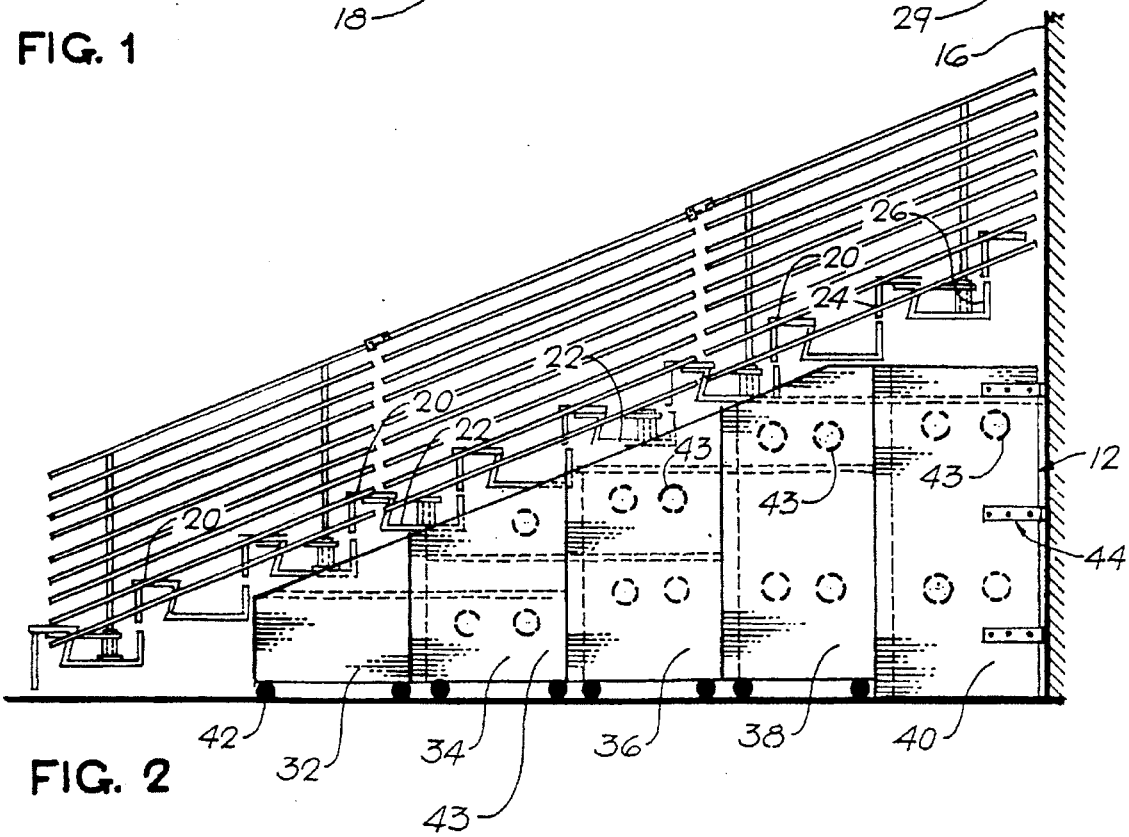
FIG. 2 is a side perspective of the preferred embodiment of the present invention connected to a telescoping bleacher assembly in the extended state.

There is illustrated in FIG. 1 a side perspective of a typical telescoping bleacher assembly in the extended state. There is illustrated in FIG. 2 a side perspective of the preferred embodiment of the present invention connected to a telescoping bleacher assembly in the extended state. The automatic end closure system 12 of this invention is therein shown in FIG. 2 installed with a multi-tiered telescoping bleacher assembly, indicated generally at 14. Multi-tiered telescoping bleacher assembly 14 is composed of a frame 18, a guard rail 19, a plurality of rows of seats 20, a plurality of rows of foot decks 22, a plurality of front risers 24 and a plurality of rear risers 26.

In FIGS. 1 and 2, the bleacher assembly 14 is in its extended or open state in which all of the plurality of rows of seats 20 and their corresponding plurality of rows of foot decks 22, except the stationary top most row of seats 20 and its corresponding row of foot deck 22, are moved successively outwardly (bottom to top) to provide the familiar tiered bleacher seating. Once extended, the undersection 27 of the bleacher assembly 14 is exposed and open to spectators at the event. The undersection 27, as shown in FIG. 1, may contain the drive motor 29 and related mechanism for automatically extending and retracting the bleacher assembly 14. The undersection 27 also contains the frame 18 which supports the bleacher assembly 14. Thus, the undersection 27 of the bleacher assembly 14 provides a tempting target for mischievous and curious spectators at the event which increases the potential liability to the facility. It will be understood that this invention is particularly directed to preventing the ingress and egress to the undersection 27 of the bleacher assembly 14 and thereby providing a safer environment which is substantially vandal-free.

The automatic end closure system 12 consists of a plurality of generally planar panels designated 32, 34, 36, 38 and 40. The number of panels will vary depending on the number and size of the bleacher sections to be covered by the automatic end closure system 12. FIG. 2 illustrate only five panels however the present invention may consists often panels for a larger bleacher assembly, twenty panels for a still larger bleacher assembly, and so on for any size of bleacher assembly. The most rearward panel 40 is a stationary panel and is anchored to a stationary support 16 which is usually a vertical wall. The means for attaching the stationary panel 40 to the stationary support 16 is preferably a "L" shaped plate 44 bolted to the panel 40 and the support 16. In one embodiment, the plurality of panels 32–38 are designed to match the height of the corresponding foot deck 22 of the bleacher assembly 14 with the panels 32–38 rearwardly becoming progressively taller with the stationary panel 40 the tallest. The height of each panel of the plurality of panels 32–38 corresponds to the vertical distance from substantially the floor to the row of foot decks 22 which is directly above the panel 32–38. In the preferred embodiment, each panel of the plurality of panels 32–38 corresponds to two rows of seats 20. In this embodiment, the height of each panel of the plurality of panels 32–38 generally will match the height of the most rearward of the associated two rows of seats 20. If the height of the plurality of panels 32–38 is descending rearward to forward in a continual manner as illustrated in FIG. 2, then the height of each panel of the plurality of panels 32–38 descends from a high point near the midpoint of the rearward row of foot decks 22 to near the midpoint of the associated forward row of foot decks 22. In an alternative embodiment, the length of each panel 32–38 corresponds to the length of a single row of seats 20, from front riser 24 to rear riser 26.

In the preferred embodiment, the plurality of panels 32–38 are designed to automatically extend forward and retract rearward with the movement of the bleacher assembly 14. The extension or retraction of the automatic end closure system 12 is accomplished with the assistance of wheels 42 connected to the bottom of each panel of the plurality of panels 32–38. Wheels 42 also provide independent moveably undersupport for the automatic end closure system 12.

Specifically referring to the embodiment illustrated FIG. 2, the plurality of panels 32–40 have a plurality of portholes 43 therethrough to allow for viewing of the undersection 27 when the bleacher assembly 14 is in its extended slate. The plurality of portholes 43 are selectively positioned among the plurality of panels 32–40 to allow for the greatest viewing of the undersection 27 without deterring from the ability of the automatic end closure system 12 to prevent ingress and egress to the undersection 27 of the bleacher assembly 14. In FIG. 2, the plurality of portholes 43 are circular in shape. However the shape of the portholes 43 could be non-circular shapes including but not limited to square, hexagonal, octagonal and the like.

Figure 3:
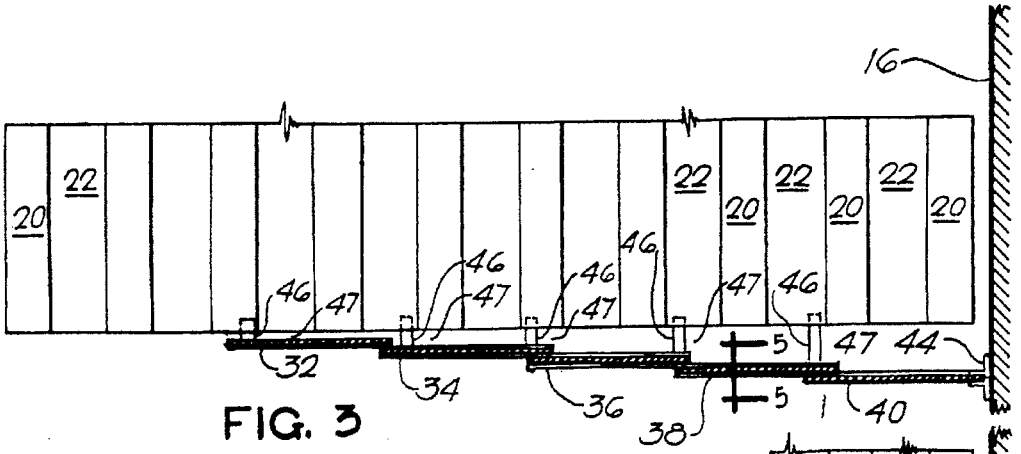
FIG. 3 is a top perspective of the preferred embodiment of the present invention connected to a telescoping bleacher assembly in the extended state.

There is illustrated in FIG. 3 a top perspective of the preferred embodiment of the present invention connected to a telescoping bleacher assembly in the extended state. As shown in FIG. 3, the automatic end closure system 12 is connected to the bleacher assembly 14 by a plurality of frame connectors 46. In the preferred embodiment, frame connectors 46 are connected to each panel of the plurality of panels 32–38 and to the frame 18 of the bleacher assembly 14 at two row intervals. When connected in this manner, end closure 12 automatically extends and retracts with the movement of bleacher assembly 14.

The automatic end closure system 12 is designed such that the plurality of panels 32–38 are slidable forward and forward in a non-interfering manner with each other panel. In this design, the plurality of panels 32–38 have individual movement paths which are parallel to each other. However, this design allows for a rearward increasing chasm 47 as each succeeding rearward panel 32–40 is a greater lateral distance away from the bleacher assembly 14 than the proceeding panel 32–40. It is anticipated that uppersection guard rails 19 would prevent access to the undersection 27 through this chasm 47. In the alternative, a foam cushion piece or the like may be used to cover the chasm 47.

Figure 4:
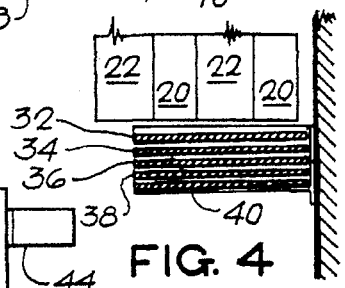
FIG. 4 is a top perspective of the preferred embodiment of the present invention connected to a telescoping bleacher assembly in the retracted state.

There is illustrated in FIG. 4 a top perspective of the preferred embodiment of the present invention connected to a telescoping bleacher assembly in the retracted state. As shown in FIG. 4, the automatic end closure system 12 in the retracted state has the plurality of panels 32–40 horizontally juxtaposed to each other. In this design, the automatic end closure system 12 does not substantially increase the amount of a space occupied by the bleacher assembly 14 thereby conserving space when not in use for an event. The automatic end closure system 12 also substantially prevents ingress and egress to the undersection 27 when the bleacher assembly 14 is in its retracted state.

Figure 5:
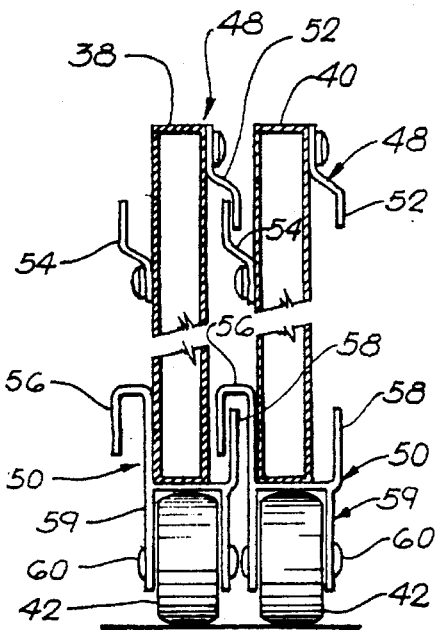
FIG. 5 is a front perspective cross section of two panels of the present invention connected to each other in order to illustrate the preferred embodiment of the guidance tracks of the present invention.
Figure 7:
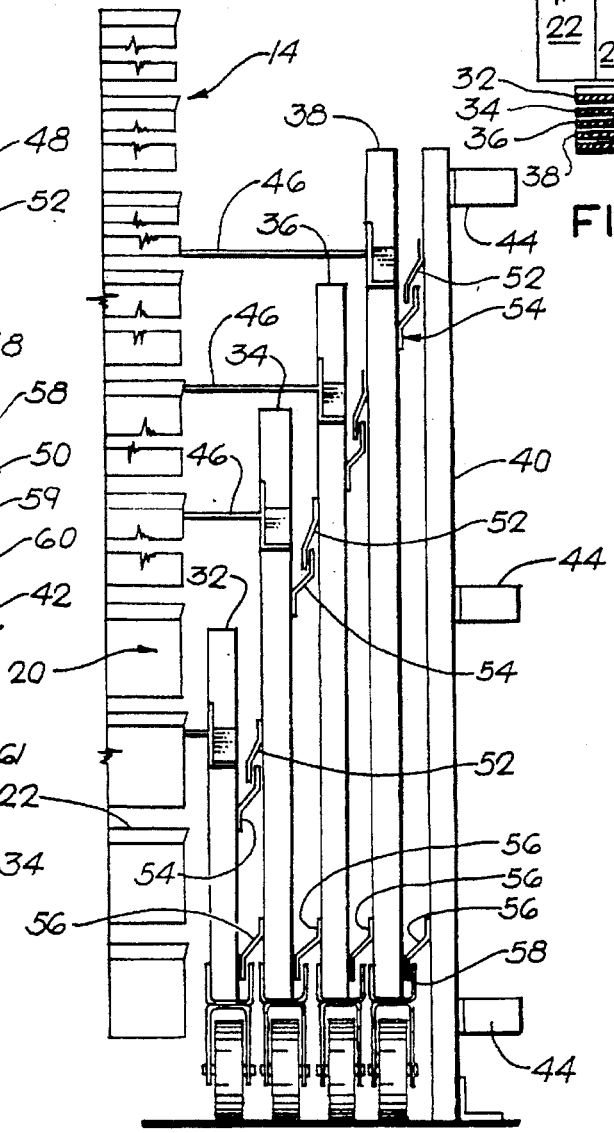
FIG. 7 is a front perspective of the present invention connected to a telescoping bleacher assembly in a retracted state which also illustrates an alternative embodiment of the bottom guidance track of the present invention.

There is illustrated in FIG. 5 a front perspective cross section of two panels 38 and 40 of the present invention connected to each other in order to illustrate the preferred embodiment of the guidance tracks of the present invention. There is illustrated in FIG. 7 a front perspective of the present invention connected to a telescoping bleacher assembly in a retracted state which also illustrates an alternative embodiment of the bottom guidance track of the present invention. As shown in FIG. 5, the top guidance tracks are generally designated 48 and the bottom guidance tracks are generally designated 50. Both guidance tracks 48 and 50 provide means for slidably connecting the plurality of panels 32–40 to each other. Each panel of the plurality of panels 32–40 has a top guidance track 48 and a bottom guidance track 50.

Each track of the plurality of top guidance tracks 48 is composed of an upper arm 52 and a lower rail 54. For each top guidance track 48, an upper arm 52 is connected to one of the plurality of panels 32–40 and the lower rail 54 is connected to the neighboring panel 32–40. Thus, on a single panel, for example panel 34, the lower rail 54 is on one side of the panel 34 while the upper arm 52 is on the opposite side, with the upper arm 52 and the lower rail 54 corresponding to two separate top guidance tracks 48. The plurality of top guidance tracks 48 are generally located in the top end region of the sides of the plurality of panels 32–40. The plurality of bottom guidance tracks 50 are generally located in the bottom end region of the sides of the plurality of panels 32–40. However it will be appreciated by those skilled in the pertinent art that the plurality of guidance tracks 48 and 50 may be positioned at any region along the sides of the plurality of panels 32–40 as long as the plurality of panels 32–40 are slidably connected in a non-interfering manner and the vertical integrity, of the automatic end closure system 12 is maintained by the plurality of guidance tracks 48 and 50.

Each track of the plurality of bottom guidance tracks 50 is composed of an upper arm 56 and a lower rail 58. In the preferred embodiment, the bottom guidance track 50 is a one piece metal track having an upside-down "U" shaped section which forms the upper arm 56 at its rearward end, a flat base attached to the bottom of each of the plurality of panels 32–38 and an upwardly projecting section on the opposite side of the "U" shaped section which forms the lower rail 58. In an alternative embodiment, the upper arm 56 is a separate piece from the lower rail 58 as shown in FIG. 7. In this alternative embodiment, the upper arm 56 is composed of a first straight section connected to a panel 32–38 which at one end becomes a diagonal section which then becomes a second straight section which is itself parallel to the first straight section. This second straight section will overlap the lower rail 58 which is itself a "U" shaped piece connected to the bottom of a panel 32–38.

The lower rails 54 and 58 latitudinally extend along the length of each panel of the plurality of panels 32–40. The upper arms 52 and 56 are positioned substantially near the rearward end of each panel of the plurality of panels 32–40. As shown in FIGS. 5 and 7, the upper arm 52 and the lower rail 54 of the top guidance tracks 48 are positioned to overlap in order to connect the plurality of panels 32–40 to each other. In the preferred embodiment, the upper arms 52 and 56 are bolted to each of their corresponding panels 32–40. However, other methods of connecting the upper arms 52 and 56 to the panels 32–40 are possible including adhesion, indentation, and the like.

Referring specifically to FIG. 7, the horizontal juxtaposition of the plurality of panels 32–40 is better illustrated. The bleacher assembly 14 is in its collapsed or retracted state in which the multi-tiered cantilever supported rows of seats 20 and rows of foot decks 22 are superposed in a vertical stacked relationship. Also, the frame connectors 46 are shown as vertically juxtaposed on each other in the retracted state. This allows the plurality of panels 32–40 to be positioned laterally parallel to each other to conserve space. The frame connectors 46 are connected to panels 32–40 and the frame 18 at two row intervals. However other embodiments might have the frame connectors 46 connected at single row intervals. Still other embodiments might have only one frame connector 46 connected to the most forward panel 32 and the frame 18.

Referring again to FIG. 5, the wheels 42 are connected to each track of the plurality of bottom guidance tracks 50. The wheels 42 provide moveably undersupport for the automatic end closure system 12 independent of the bleacher assembly 14. A plurality of wheel flanges 59 are connected to each track of the plurality of bottom guidance tracks 50, usually at the most forward and rearward positions. The wheels 42 are connected to the wheel flanges 59 by bolts 60.

Figure 6:
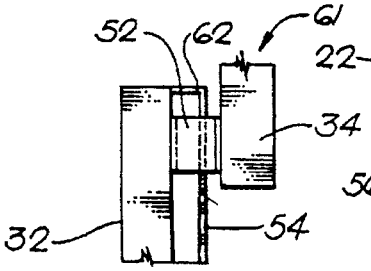
FIG. 6 is a top perspective of the panel locking engagements of the present invention.

There is illustrated in FIG. 6 a top perspective of the panel locking engagements of the present invention. The panel locking engagements, generally designated 61, provide means for preventing the disconnection of the plurality of panels 32–40 from each other when the automatic end closure system 12 is being extended and retracted. In the preferred embodiment, the panel locking engagements 61 consists of the lower rail 54 of each track of the plurality of top guidance tracks 48 closed off at one end in order to prevent further movement of the overlapping upper arm 52. The rearward section 62 of each lower rail 54 is bent perpendicular to the rest of the rail 54 in order to prevent the disengagement of the panels 32–40 from each other. A similar design is used for the panel locking engagements of each track of the plurality of bottom guidance tracks 50. In this design, the plurality of panels 32–40 are slidably connected to each other which maintains the integrity of the automatic end closure system 12. It should be well understood by those skilled in the pertinent art that a second panel locking engagement may be placed on the forward end of each of the top and bottom guidance tracks 48 and 50 to provide further stability of the automatic end closure system 12.

Figure 8:
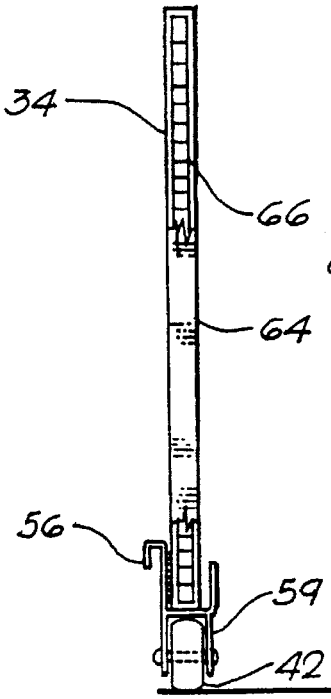
FIG. 8 is a front perspective of a panel of the present invention without a top or bottom guidance track.
Figure 9:
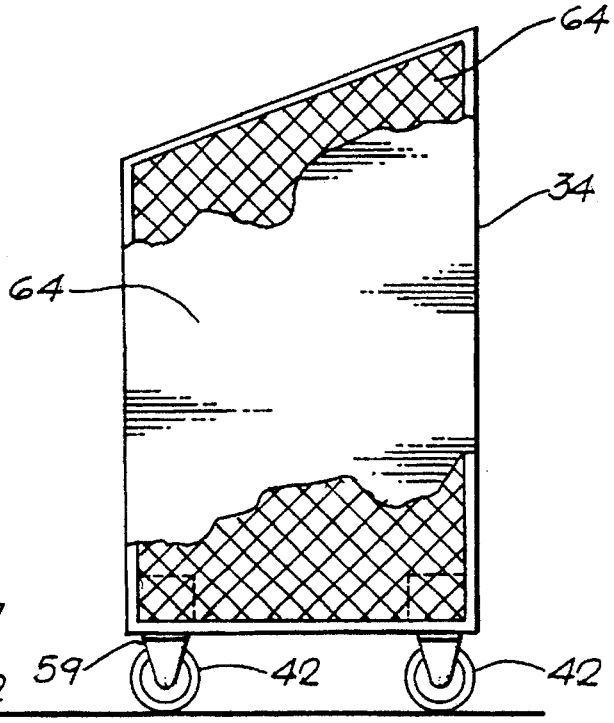
FIG. 9 is a side perspective of a panel of the present invention without a top or bottom guidance track.

There is illustrated in FIG. 8 a front perspective of a panel of the present invention without a top or bottom guidance track. There is illustrated in FIG. 9 a side perspective of a panel of the present invention without a top or bottom guidance track. As shown in FIGS. 8 and 9, the plurality of panels 32–40 are composed of an outer coveting 64 connected to an inner framing 66. In the preferred embodiment, the inner framing 66 is a metal frame providing for support and stability of each panel of the plurality of panels 32–40. The outer covering 64 is preferably composed of a stained wood to provide an aesthetically appealing facade with strength to resist intruders. However in other embodiments, the outer covering 64 of the plurality of panels 32–40 might consist of aluminum, tin, plastics, other woods and the like placed on a metal frame. Whatever the composition of the inner framing 66 and outer covering 64, the plurality of panels 32–40 are created to resist the forcible entry of intruders to the undersection 27 of the bleacher assembly 14.

Figure 10:
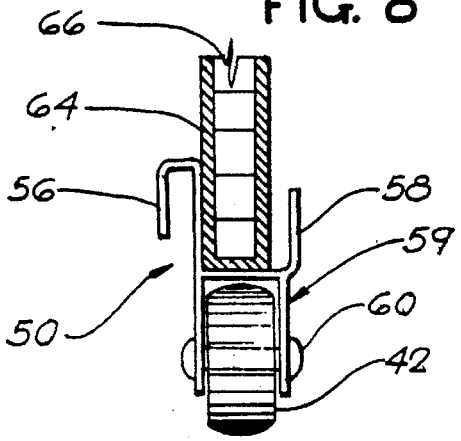
FIG. 10 is a front perspective of the wheel mechanism of the present invention.

There is illustrated in FIG. 10 a from perspective of the wheel mechanism of the present invention. As shown in FIG. 10, the wheels 42 are bolted to the wheel flanges 59 which are themselves connected to or part of each track of the plurality of bottom guidance tracks 50. In this embodiment, as better seen in FIG. 9, the weight of each panel of the plurality of panels 32–38 is distributed between two wheels 42, one positioned on the forward end of the panel and one positioned on the rearward end of the panel. Referring again to FIG. 10, the bottom guidance track 50 is shown as a singular piece having not only the upper arm 56 and lower rail 58, but also the wheel flange 59. The bottom guidance track 50 is connected to a panel 32–38 by bolts (not shown), and the wheel flange 59 is connected to the wheel 42 by a bolt 60.

In attaching the automatic end closure system 12 as an add-on component to a telescoping bleacher assembly 14, the bleacher assembly 14 should preferably be in its extended state. Assuming an automatic end closure system 12 consisting of five panels (installing an automatic end closure system 12 consisting of more or less than five panels will proceed in a similar manner), the installation should proceed in the following manner. First the most rearward panel, stationary panel 40, should be connected to the stationary support 16 by the "L" shaped plates 44. Then the next most rearward panel, panel 38, should have its lower rails 54 and 58 engaged with the upper arms 52 and 56 of the stationary panel 40. The panel 38 should be extended to its most forward position thereby engaging its panel locking engagements 61. The panel 38 should then be connected to the frame 18 of the bleacher assembly 14 by a frame connector 46. Then the next most rearward panel, panel 36, should have its lower rails 54 and 58 engaged with the upper arms 52 and 56 of the panel 38. The panel 36 should be extended to its most forward position thereby engaging its panel locking engagements 61. The panel 36 should then be connected to the frame 18 of the bleacher assembly 14 by a frame connector 46. Then the next most rearward panel, panel 34, should have its lower rails 54 and 58 engaged with the upper arms 52 and 56 of the panel 36. The panel 34 should be extended to its most forward position thereby engaging its panel locking engagements 61. The panel 34 should then be connected to the frame 18 of the bleacher assembly 14 by a frame connector 46. Finally, the most forward panel, panel 32, should have its lower rails 54 and 58 engaged with the upper arms 52 and 56 of the panel 34. The panel 32 should be extended to its most forward position thereby engaging its panel locking engagements 61. The panel 32 should then be connected to the frame 18 of the bleacher assembly 14 by a frame connector 46. The bleacher assembly 14 should then be retracted to insure that the automatic end closure system 12 automatically retracts along with the bleacher assembly 14.

From the foregoing it is believed that those skilled in the art will recognize the meritorious advancement of this invention and will readily understand that while the same has been described in association with a preferred embodiment thereof, illustrated in the accompanying drawings, numerous changes, modifications and substitutions of equivalents may be made therein without departing from the spirit and scope of this invention which is intended to be unlimited by the foregoing except as may appear in the following appended claims.

Therefore, the embodiments of the invention in which an exclusive property or privilege is claimed are defined as follows:

1. A closure system for substantially preventing ingress and egress to the open ended undersection of a telescoping bleacher assembly, comprising:

a plurality of vertical panels disposed in adjacent parallelism across the open ends of the undersection and moveable with extension and retraction movements of the bleacher assembly;

a plurality of guidance tracks attached to each panel of said plurality of panels, for guiding the same during movement thereof with the bleacher assembly; and ground engaging wheels mounted at the lower end of each of said panels for moveably undersupporting the same.

2. The combination in accordance with claim 1 further comprising means for anchoring one end of the closure system to a stationary support.

3. The combination according to claim 1, further comprising a plurality of panel locking engagements integrated into each track of said guidance tracks for preventing disconnection of said panels during extension and retraction movements with the bleacher assembly.

4. The combination according to claim 1 further comprising:

means for attaching each panel of said plurality of panels to the telescoping bleacher assembly.

5. The combination according to claim 1, wherein each track of said guidance tracks is composed of an upper arm and a lower rail.

6. The combination according to claim 5, wherein said lower rail of each said track extends horizontally across the width of each of said panels.

7. The combination according to claim 1 wherein said plurality of panels are laterally spaced from each other allowing for non-interfering movement of each panel of said plurality of panels.

8. In a telescoping bleacher assembly which extends and retracts horizontally, the bleacher assembly having an openly exposed undersection beneath a plurality of horizontal rows of seats and foot decks spaced in vertical descending relationship and moveably supported on floor engaging frames, a system for enclosing the exposed undersection comprising:

a plurality of planar panels connected to the floor engaging frames for substantially preventing ingress and egress to and from the undersection of the bleacher assembly, each panel extending vertically between the floor and a corresponding footdeck of the bleacher assembly with a rearmost said panel anchored to a stationary support;

a plurality of top guidance tracks attached to the upper end region of each panel for interconnecting said plurality of panels to one another and slidably guiding said panels during extension and retraction movements of the bleacher assembly;

a plurality of bottom guidance tracks attached to the lower end region of each panel for interconnecting said plurality of panels to one another; and slidably guiding the same during extension and retraction movements of the bleacher assembly;

wheel means mounted at the bottom end of each panel of said plurality of panels for moveably undersupporting the same; and a plurality of panel locking engagements integrated into each track of said plurality of top and bottom guidance tracks for preventing disconnection of said plurality of panels during extension and retraction movements thereof and for maintaining the integrity of the closure system.

9. The automatic end closure system according to claim 8 wherein individual panels of said plurality of panels are laterally spaced equidistant from each other allowing for non-interfering movement thereof during extension and retraction movements thereof; said plurality of panels horizontally juxtaposed during retraction.

10. The automatic end closure system according to claim 8 wherein each track of said plurality of guidance tracks consists of an upper arm connected to one of said plurality of panels and a lower rail connected to an adjacent panel, said upper arm overlapping said lower rail thereby interconnecting succeeding panels from rearward to forward, during extension of the automatic end closure system a most forward panel is extended until said panel locking engagement engages an immediately rearward panel for extension thereof in a like manner, such progression of panels continuing until all of said plurality of panels are fully extended.

11. The automatic end closure system according to claim 8 wherein said plurality of panels includes five panels of increasing height at opposite ends of the telescoping bleacher assembly.

12. The automatic end closure system according to claim 8 wherein said plurality of panels are composed of an inner metal frame substantially covered with a wooden facade.

13. The automatic end closure system according to claim 8 wherein each panel of said plurality of panels corresponds in length to one row of seats of the telescoping bleacher assembly.

14. A telescoping bleacher assembly supported on a frame and capable of forward extension and rearward retraction, comprising:

a plurality of seat and foot rest rows capable of extending forward to an extended state where the plurality of rows are in descending spaced relation to each other and capable of retracting rearward to a retraction state where the rows are superposed upon each other in a vertical column; and an automatic end closure structure positioned along at least one side of the telescoping bleacher system, said automatic end closure structure including a plurality of panels attached to the frame of the bleacher assembly, a plurality of top guidance tracks attached one to each panel of said plurality of panels, a plurality of bottom guidance tracks attached one to each panel of said plurality of panels, a plurality of ground engaging wheels attached to each track of said plurality of bottom guidance tracks, and means for anchoring said automatic end closure structure to a stationary support.

15. The telescoping bleacher assembly according to claim 14 further comprising:

a plurality of panel locking engagements, one integrated into each track of said plurality of top guidance tracks and bottom guidance tracks for preventing disconnection of said plurality of panels during extension and retraction and for maintaining the integrity of the automatic end closure structure.

16. The telescoping bleacher assembly according to claim 15 wherein each track of said plurality of guidance tracks consists of an upper arm connected to one of said plurality of panels and a lower rail connected to an adjacent panel, said upper arm overlapping said lower rail thereby slidably interconnecting succeeding panels from rearward to forward; during extension of the automatic end closure system a most forward panel is extended until said panel locking engagement thereof engages a locking engagement of an immediately rearward panel for extension thereof in a like manner, such progression of panels continuing until all of said plurality of panels are fully extended.

17. The telescoping bleacher assembly according to claim 14 wherein said plurality of panels are composed of an inner metal frame substantially covered with a wooden facade.

18. The telescoping bleacher assembly according to claim 14 wherein said plurality of panels includes five panels of increasing height at opposite ends of the telescoping bleacher assembly.

* * * * *

UNITED STATES PATENT AND TRADEMARK OFFICE

CERTIFICATE OF CORRECTION

PATENT NO. : 5,661,928

DATED : September 2, 1997

INVENTOR(S) : ROGER H. BEU

It is certified that error appears in the above-identified patent and that said Letters Patent is hereby corrected as shown below:

Col. 5, line 30, delete "often", and insert -- of ten--.

Col. 5, line 66, delete "moveably" and insert -- moveable --;

Col. 6, line 27, delete "forward" and insert -- rearward --;

Col. 9, line 53, "ground", should start a new paragraph.

Signed and Sealed this

Eighteenth Day of November 1997

Bruce Lehman

*Attest:*

BRUCE LEHMAN

*Attesting Officer*

*Commissioner of Patents and Trademarks*